US006125634A

United States Patent [19]

Wittchow

[11] Patent Number: 6,125,634

[45] Date of Patent: Oct. 3, 2000

[54] POWER PLANT

[75] Inventor: Eberhard Wittchow, Erlangen, Germany

[73] Assignee: Siemens Aktiengesellschaft, Munich, Germany

[21] Appl. No.: 09/320,001

[22] Filed: May 26, 1999

Related U.S. Application Data

[62] Division of application No. 08/129,943, Sep. 30, 1993, abandoned.

[30] Foreign Application Priority Data

Sep. 30, 1992 [DE] Germany ..... 42 32 881

[51] Int. Cl.[7] ..... F01K 7/34

[52] U.S. Cl. ..... 60/678; 60/679

[58] Field of Search ..... 60/645, 653, 678, 60/679

[56] References Cited

U.S. PATENT DOCUMENTS

| | | | |
|---|---|---|---|
| 2,830,440 | 4/1958 | Durham | 60/653 |
| 2,867,983 | 1/1959 | Armcost . | |
| 3,016,712 | 1/1962 | Taylor | 60/679 X |
| 3,105,357 | 10/1963 | Vogler | 60/679 X |
| 3,238,729 | 3/1966 | Frankel et al. . | |
| 3,277,651 | 10/1966 | Augsburger | 60/679 X |
| 3,329,478 | 7/1967 | Garlet . | |
| 3,565,575 | 2/1971 | Warshaw . | |
| 3,671,185 | 6/1972 | Lefrancois et al. . | |
| 3,724,212 | 4/1973 | Bell | 60/653 X |
| 3,921,406 | 11/1975 | Teranishi et al. . | |
| 4,297,319 | 10/1981 | Ishibashi et al. . | |
| 4,309,386 | 1/1982 | Pirsh . | |
| 4,430,962 | 2/1984 | Miszak . | |
| 4,535,594 | 8/1985 | Allam et al. . | |
| 4,748,815 | 6/1988 | Junior et al. . | |
| 4,873,827 | 10/1989 | Hadano et al. . | |
| 5,070,821 | 12/1991 | Virr . | |
| 5,120,508 | 6/1992 | Jones . | |
| 5,237,939 | 8/1993 | Spokoyny et al. . | |

FOREIGN PATENT DOCUMENTS 0 054 601 B1 6/1982 European Pat. Off. .

OTHER PUBLICATIONS

"$No_x$–removal from flue gases according to the method of selective catalytic reduction (SCR)" (Erath et al.), Chemie–Technik, vol. 15, No. 2, 1986.

*Primary Examiner*—Hoang Nguyen
*Attorney, Agent, or Firm*—Herbert L. Lerner; Laurence A. Greenberg; Werner H. Stemer

[57] ABSTRACT

A method for operating a power plant includes generating flue gas in a furnace of a fossil-fueled steam generator and generating steam for a steam turbine from heat contained in the flue gas. The steam is superheated prior to entry into the steam turbine and after partial expansion in the steam turbine. Feedwater is preheated exclusively outside the steam generator. The preheated feedwater is evaporated at high pressure. Nitrogen is removed from the hot flue gas directly following heat exchange of the flue gas with the partially expanded steam. A power plant includes a fossil-fueled steam generator having a combustion chamber wall being constructed as an evaporator heating surface, a number of tubes of the evaporator heating surface being gas-tightly joined together and having inlet ends, an inlet collector communicating with the inlet ends of the tubes, and an intermediate superheater. A $deNO_x$ device is disposed directly downstream of the intermediate superheater in flow direction of flue gas. A steam turbine is disposed downstream of the steam generator. A feedwater preheater is disposed outside the steam generator. An inlet side of the feedwater preheater communicates with the steam turbine and a feedwater line directly connects an outlet side of the feedwater preheater with the inlet collector.

4 Claims, 1 Drawing Sheet

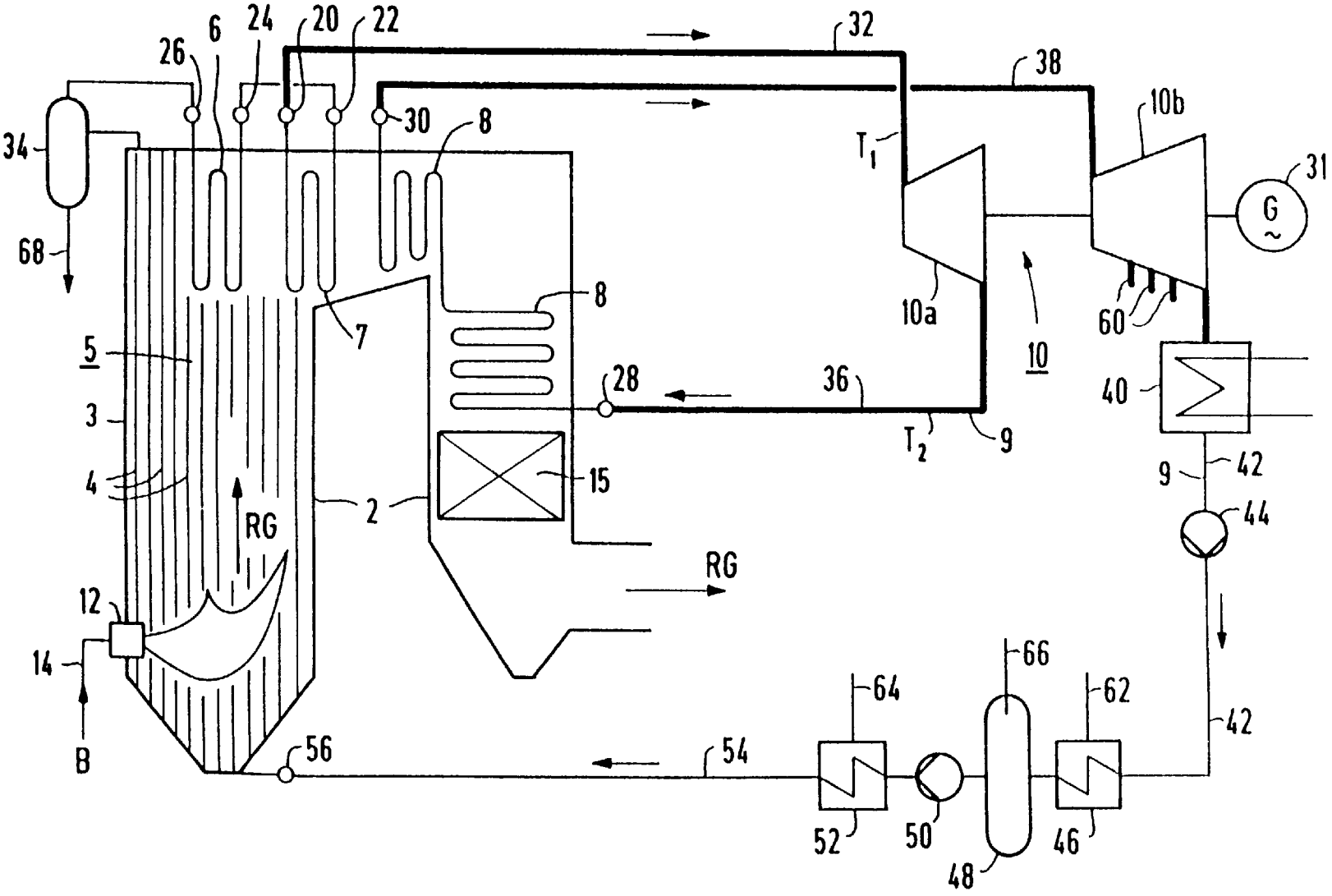
31
G
10b
38
32
10
10a
T1
T2
9
36
28
8
15
RG
2
7
30
22
20
24
6
26
34
68
5
3
4
12
14
B
56
54
52
64
50
66
48
46
62
42
44
40
60

POWER PLANT

CROSS-REFERENCE TO RELATED APPLICATION

This application is a division of application Ser. No. 08/129,943, filed Sep. 30, 1993 now abandoned.

BACKGROUND OF THE INVENTION

1. Field of the Invention

The invention relates to a method for operating a power plant with a fossil-fueled steam generator, in which heat contained in flue gas from a furnace is utilized to generate steam for a steam turbine and nitrogen is removed from the hot flue gas, preheated feedwater at high pressure is evaporated, and steam being produced is superheated prior to entry into the steam turbine and after partial depressurization or expansion in the steam turbine. The invention is also directed to a power plant operated by this method.

In such a power plant, which is also referred to as a steam power plant, heating surfaces of the fossil-fueled steam generator are connected into a water-steam loop of the steam turbine. The tubes joined together in gas-tight fashion to form a combustion chamber wall of the steam generator form an evaporator heating surface, which is connected with the other heating surfaces that are also disposed inside the steam generator. The further heating surfaces are typically a high-pressure superheater or economizer for preheating the feedwater and a high-pressure superheater for final superheating of the steam being generated, as well as an intermediate superheater for re-superheating the partially depressurized or expanded steam in a high-pressure portion of the steam turbine.

The steam generation is effected by transferring the heat contained in the flue gas from the furnace to the medium flowing in the water-steam loop. In order to achieve the highest possible efficiency of the power plant, the heating surfaces are disposed in different temperature regions of the steam generator, for the sake of adaptation to the temperature course of the flue gas. Typically, in terms of the flow direction of the flue gas, the intermediate superheater is disposed downstream of the high-pressure superheater, and upstream of the economizer.

A power plant having such a heating surface configuration inside the steam generator is known from European Patent No.0 054 601 B1, for example. In that known power plant, in addition to the economizer, two further high-pressure preheaters are provided upstream, inside the water-steam loop and outside the steam generator. The fresh steam state achieved thus far, that is the temperature and the pressure of the steam upon its entry into the steam turbine, is at a pressure of 250 bar at maximum and a temperature of 545° C. at maximum.

In a power plant having a nitrogen removal system or device (de$NO_x$ device) operating by the principle of selective catalytic reduction (SCR process), the device is typically disposed inside the steam generator downstream of the economizer in the flow direction of the flue gas. Since the temperature of the flue gas inside the steam generator and therefore in the region of the nitrogen removal system varies as well when load changes take place in the power plant, the temperature drops below the operating temperature of the nitrogen removal system, of approximately 300° to 350° C., in various operating states, particularly in the partial load range. In that case, adequate flue gas cleaning is no longer possible.

In order to assure adequate cleaning of the flue gas even if the flue gas temperature downstream of the economizer drops below the operating temperature of the de$NO_x$ device, a so-called ECO bypass is provided in accordance with a circuit known from a publication entitled: "Chemie-Technik" [Chemical Technology], Vol. 15, No. 2, 1986, pp. 17 ff., particularly FIG. 3 on page 18. Through that bypass, an adjustable partial flow of flue gas withdrawn upstream of the economizer is admixed with the flue gas downstream of the economizer. Thus the flue gas temperature, for instance in partial load operation, is increased accordingly in the region of the nitrogen removal system. However, with that provision, which involves especially major technological effort and expense, the reaction temperature for the nitrogen removal system can merely be kept in the vicinity of an especially advantageous value.

SUMMARY OF THE INVENTION

It is accordingly an object of the invention to provide a method for operating a power plant and a plant operating according to the method, which overcome the hereinaforementioned disadvantages of the hereto fore-known methods and devices of this general type and which do so in such a way that an especially advantageous temperature performance for the function of the nitrogen removal system is assured, regardless of the load state. This should be achieved with the least possible technological effort or expense, yet without restricting the overall efficiency of the power plant.

With the foregoing and other objects in view there is provided, in accordance with the invention, a method for operating a power plant, which comprises generating flue gas in a furnace of a fossil-fueled steam generator; generating steam for a steam turbine from heat contained in the flue gas; superheating the steam prior to entry into the steam turbine and after partial expansion or depressurization in the steam turbine; preheating feedwater exclusively outside the steam generator; evaporating the preheated feedwater at high pressure; and removing nitrogen from the hot flue gas directly following heat exchange of the flue gas with the partially expanded or depressurized steam.

The invention takes as its point of departure the concept that the temperature of the steam at the outlet of the high-pressure portion of the steam turbine is virtually constant regardless of the load state of the power plant. Therefore, if preheating of the feedwater takes place exclusively outside the steam generator, thus dispensing with the economizer provided previously, and if the last water-cooled or steam-cooled heating surface, in terms of the flue gas flow direction, is the intermediate superheater, then as a result of the likewise virtually constant steam temperature at the entry to the intermediate superheater, the flue gas temperature in the region of the nitrogen removal system also remains virtually constant, virtually independently of the load. As a result, especially advantageous reaction temperatures are always adhered to for the nitrogen removal system, even in the partial-load range.

Preheating of the feedwater may, for instance, be performed with the aid of an additionally furnished heater.

In accordance with another mode of the invention, there is provided a method which comprises preheating the feedwater by heat exchange with steam from the steam turbine.

In accordance with a further mode of the invention, there is provided a method which comprises setting the pressure of the superheated steam before its entry into the steam turbine at least at 260 bar in normal operation at full load, which attains an especially advantageous overall efficiency of the power plant.

In accordance with a further mode of the invention, there is provided a method which comprises setting the temperature of the partially depressurized or expanded steam before its re-superheating to be approximately constant and at most at 340° C. in normal operation at full load, because this temperature is also the preferred operating temperature of the $deNO_x$ system.

With the objects of the invention in view, there is also provided a power plant, comprising a fossil-fueled steam generator including a combustion chamber wall being constructed as an evaporator heating surface, a number of tubes of the evaporator heating surface being gas-tightly joined together and having inlet ends, an inlet collector communicating with the inlet ends of the tubes, and an intermediate superheater; a $deNO_x$ device disposed directly downstream of the intermediate superheater in flow direction of flue gas from the steam generator; a steam turbine disposed downstream of the steam generator in steam flow direction; a feedwater preheater being disposed outside the steam generator and having inlet and outlet sides, the inlet side of the feedwater preheater communicating with the steam turbine; and a feedwater line directly connecting the outlet side of the feedwater preheater with the inlet collector.

In accordance with another feature of the invention, the steam turbine has a high-pressure part and a medium-pressure or low-pressure part, and the intermediate superheater has an inlet side communicating with the high-pressure part of the steam turbine and an outlet side communicating with the medium-pressure or low-pressure part of the steam turbine.

In accordance with a further feature of the invention, the steam generator has an outlet at which the $deNO_x$ device is disposed.

In accordance with a concomitant feature of the invention, there are provided means for heating the feedwater preheater with steam from the steam turbine.

The advantages attained with the invention are in particular that on one hand the flue gas temperature in the region of the nitrogen removal system is virtually constant, independently of the load state of the power plant. On the other hand, by preheating the feedwater exclusively outside the steam generator, the mean combustion chamber wall temperature drops, because there is a comparatively major temperature difference in the medium at the entry to and at the outlet from the evaporator heating surface. As a result, a fresh steam state at the entry to the steam turbine with a steam pressure of approximately 300 bar and a steam temperature of approximately 600° C. is attainable, and consequently the carbon dioxide emissions of the power plant are especially low.

Other features which are considered as characteristic for the invention are set forth in the appended claims.

Although the invention is illustrated and described herein as embodied in a method for operating a power plant and a plant operating according to the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The FIGURE is a schematic circuit diagram of an exemplary embodiment of the invention.

DESCRIPTION OF THE PREFERRED EMBODIMENTS

Referring now to the single figure of the drawing in detail, there is seen a power plant with a steam generator, which includes a nitrogen removal system and has an evaporator heating surface which communicates on the inlet side directly with a feedwater preheater disposed outside.

The power plant shown in the drawing includes a steam generator 2, having a combustion chamber wall 3 which is constructed from tubes 4 that are joined together in gas-tight fashion to form a vertical gas flue or draft. The tubes 4 of the combustion chamber wall 3 form heating surfaces of an evaporator 5. Two high-pressure superheaters 6 and 7 and one intermediate superheater 8 are disposed inside the steam generator 2 as further heating surfaces, in a convection draft or flue following the vertical gas flue. These heating surfaces, that is the evaporator 5, the superheaters 6 and 7 and the intermediate superheater 8, are incorporated into a water-steam loop 9 of a steam turbine 10.

A furnace system 12 into which a fuel line 14 discharges is provided in the lower part of the combustion chamber wall 3 of the steam generator 2. A $deNO_x$ device 15 for removing nitrogen from flue gas RG is also disposed inside the steam generator 2, downstream of the intermediate superheater 8, as is seen in the flow direction of the flue gas RG produced in the furnace system 12. Tubes of the superheaters 6 and 7 and the intermediate superheater 8 communicate with collectors 20–30 provided outside the steam generator 2. These include an inlet collector 22 and an outlet collector 20 of the superheater 7, an inlet collector 26 and an outlet collector 24 of the superheater 6, and an inlet collector 28 and an outlet collector 30 of the superheater 8.

The steam turbine 10 includes a high-pressure part **10*a* and a medium-pressure or low-pressure part 10*b*, which together drive a generator 31. The high-pressure part 10*a* of the steam turbine 10 communicates on the inlet side, through a fresh steam line 32, with the outlet collector 20 of the superheater 7. The superheater 7 communicates through its inlet collector 22 with the outlet collector 24 of the superheater 6, which in turn communicates through its inlet collector 26 with a water-steam separator vessel 34. The water-steam separator vessel 34 communicates on the inlet side with outlet ends of the tubes 4 of the evaporator 5**.

The high-pressure part **10*a* also communicates on the outlet side, through a steam line 36, with the inlet collector 28 of the intermediate superheater 8. The outlet collector 30 of the intermediate superheater 8 communicates through a steam line 38 with an inlet of the medium-pressure or low-pressure part 10*b* of the steam turbine 10**.

The medium-pressure or low-pressure part **10*b* of the steam turbine 10 communicates on the outlet side with a condenser 40. The condenser in turn communicates on the outlet side, through a condensate line 42 into which a condensate pump 44 is connected, with a low-pressure condensate preheater 46. This preheater 46 in turn communicates through a feedwater tank 48 and a feed pump 50 with a high-pressure feedwater preheater 52. This preheater 52 communicates on the outlet side, through a feedwater line 54, with an inlet collector 56 that communicates with inlet ends of the tubes 4 of the evaporator 5**.

In operation of the power plant, steam produced inside the steam generator 2 is delivered to the steam turbine 10.

There the steam depressurizes or expands and in so doing drives the steam turbine 10. This turbine 10 in turn drives the generator 31. The steam production takes place due to heat transfer from the hot flue gas RG flowing through the steam generator 2 on the primary side to the water or water-steam-mixture flowing through the steam generator 2 on the secondary side.

The flue gas RG is produced from combustion of fuel B delivered to the furnace system 12 through the fuel line 14. The flue gas RG that cools along its course through the steam generator 2 is freed of nitrogen in the $deNO_x$ device 15. The cleaned flue gas RG leaves the steam generator 2 in the direction of a non-illustrated chimney.

The depressurized or expanded steam flowing out of the medium-pressure or low-pressure part 10*b* flows into the condenser 40 and condenses there. Condensate collecting in the condenser 40 is fed through the condensate pump 44 and the low-pressure condensate preheater 46 into the feedwater container 48. From there the feedwater is delivered, by means of the feedwater pump 50, through the high-pressure feedwater preheater 52 to the inlet collector 56 of the evaporator 5.

The preheating of the feedwater, which is at high pressure, takes place exclusively outside the steam generator 2. The preheating of the condensate, which is at low pressure, also takes place outside the steam generator 2. In the case of preheating, both the high-pressure feedwater preheater 52 and the low-pressure condensate preheater 46 are supplied with steam from the steam turbine 10. This steam is taken from the medium-pressure or low-pressure part 10*b* at suitable withdrawal points 60 and is delivered over respective lines 62 and 64 to the low-pressure condensate preheater 46 and to the high-pressure feedwater preheater 52. Withdrawn steam is also delivered to the feedwater tank 48 through a line 66.

The preheated, high-pressure feedwater delivered to the steam generator 2 through the inlet collector 56 is evaporated in the evaporator 5. The resultant water-steam mixture flows into the water-steam separator vessel 34. There, water and steam are separated from one another. The water leaves the water-steam separator vessel 34 through a line 68. The steam that has been separated out is delivered to the evaporators 6 and 7 and superheated there. The superheated steam flows through the fresh steam line 32 into the high-pressure part 10*a* of the steam turbine 10. A temperature $T_1$ of the superheated steam, upon its entry into the steam turbine 10, is 600° C., for instance. The associated steam pressure is 300 bar, for instance, but is at least 260 bar. A temperature $T_2$ of the steam leaving the high-pressure part 10*a* at reduced pressure amounts to approximately 300 to a maximum of 340° C. prior to its re-superheating in the intermediate superheater 8. This temperature $T_2$ can be kept virtually constant regardless of the operating state of the power plant. Since the last water-cooled or steam-cooled heating surface, as viewed in the flow direction of the flue gas RG, is the intermediate superheater 8, and this superheater is disposed in the steam generator 2 directly upstream of the $deNO_x$ device or system 15, the flue gas temperature in this region inside the steam generator 2 likewise remains virtually constant. Therefore, the requisite reaction temperatures for the $deNO_x$ system 15 are always adhered to regardless of load, or in other words even in the partial-load mode of the power plant.

Since the feedwater is preheated exclusively outside the steam generator 2, an economizer that is typically provided between the intermediate superheater 8 and the $deNO_x$ system 15 can be dispensed with. As a result, advantageously, on one hand the flue gas temperature in the region of the $deNO_x$ system 15 is virtually constant, regardless of load. On the other hand, because of the comparatively great temperature difference between the steam temperatures at the input and the outlet of the evaporator 5, as compared with previously known circuits, the mean temperature of the combustion chamber wall 3 is lowered, because the tubes 4 of the evaporator 5 are better cooled. Through the use of this kind of construction of the fossil-fueled power plant, the carbon dioxide emissions are advantageously kept especially low.

I claim:

1. A power plant, comprising:

a fossil-fueled steam generator including a combustion chamber wall being constructed as an evaporator heating surface, a number of tubes of said evaporator heating surface being gas-tightly joined together and having inlet ends, an inlet collector communicating with the inlet ends of said tubes, and an intermediate superheater;

a $deNO_x$ device disposed directly downstream of said intermediate superheater in low direction of flue gas from said steam generator;

a steam turbine disposed downstream of said steam generator in steam flow direction;

a feedwater preheater being disposed outside said steam generator and having inlet and outlet sides, the inlet side of said feedwater preheater communicating with said steam turbine; and a feedwater line directly connecting the outlet side of said feedwater preheater with said inlet collector.

2. The power plant according to claim 1, wherein said steam turbine has a high-pressure part and a medium-pressure or low-pressure part, and said intermediate superheater has an inlet side communicating with said high-pressure part of said steam turbine and an outlet side communicating with said medium-pressure or low-pressure part of said steam turbine.

3. The power plant according to claim 1, wherein said steam generator has an outlet at which said $deNO_x$ device is disposed.

4. The power plant according to claim 1, including means for heating said feedwater preheater with steam from said steam turbine.

* * * * *